US008776480B2

(12) United States Patent
Kabel

(10) Patent No.: US 8,776,480 B2
(45) Date of Patent: Jul. 15, 2014

(54) VENTED NAIL BASE ROOF ASSEMBLY AND ASSOCIATED METHOD

(76) Inventor: Joseph A. Kabel, Batavia, OH (US)

( * ) Notice: Subject to any disclaimer, the term of this patent is extended or adjusted under 35 U.S.C. 154(b) by 154 days.

(21) Appl. No.: 13/355,764

(22) Filed: Jan. 23, 2012

(65) Prior Publication Data

US 2012/0186177 A1 Jul. 26, 2012

Related U.S. Application Data

(60) Provisional application No. 61/435,521, filed on Jan. 24, 2011.

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04D 13/17*** | (2006.01) |

(52) U.S. Cl.

CPC ..... *E04D 13/17* (2013.01)
USPC ..... 52/746.11; 52/302.3; 52/198; 52/95

(58) Field of Classification Search

CPC .... E04D 13/17; E04D 13/172; E04D 13/0445
USPC ..... 52/94, 95, 186, 198, 199, 302.1, 302.3, 52/746.11
See application file for complete search history.

(56) References Cited

U.S. PATENT DOCUMENTS

| | | | | |
|---|---|---|---|---|
| 4,507,901 | A * | 4/1985 | Carroll | 52/302.3 |
| 4,635,419 | A * | 1/1987 | Forrest | 52/302.3 |
| 4,907,910 | A * | 3/1990 | Teron | 405/132 |
| 5,022,314 | A * | 6/1991 | Waggoner | 454/250 |
| 5,603,657 | A * | 2/1997 | Sells | 454/359 |
| 6,780,099 | B1 * | 8/2004 | Harper | 454/186 |
| 7,143,557 | B1 * | 12/2006 | Ayers, Jr. | 52/302.1 |
| 8,100,341 | B1 * | 1/2012 | Roderick et al. | 236/49.3 |
| 8,245,947 | B2 * | 8/2012 | Roderick et al. | 236/49.3 |
| 8,281,522 | B1 * | 10/2012 | Hawryshko et al. | 52/95 |
| 2004/0200170 | A1 * | 10/2004 | Fabel | 52/506.01 |
| 2006/0123724 | A1 * | 6/2006 | Pollack | 52/302.1 |
| 2011/0265407 | A1 * | 11/2011 | Bryson | 52/302.1 |

* cited by examiner

*Primary Examiner* — William Gilbert
*Assistant Examiner* — Alp Akbasli
(74) *Attorney, Agent, or Firm* — Wood, Herron & Evans, LLP

(57) ABSTRACT

A roof assembly for covering a building includes a first structural layer coupled to the framework of the building, a second structural layer positioned above the first structural layer, and an insulating layer including a roof insulation panel positioned between the first and second structural layers. A ventilating purlin extends between and contacts the first and second structural layers along at least one edge of the roof insulation panel. The ventilating purlin transfers loads from the second structural layer to the first structural layer without using the insulating layer for structural support. The ventilating purlin also includes at least one ventilation opening positioned to enable air flow through the ventilating purlin into a ventilating layer of air space formed between the insulating layer and the second structural layer. Thus, the ventilating purlin permits full ventilation of the roof assembly.

16 Claims, 6 Drawing Sheets

VENTED NAIL BASE ROOF ASSEMBLY AND ASSOCIATED METHOD

TECHNICAL FIELD

This invention generally relates to a roof assembly and a method of installing a roof, and more particularly to a roof assembly and method using a vented nail base (VNB) roof construction.

BACKGROUND

In roof construction for buildings and residences, various types of roof assemblies have been used to protect the interior of the building from precipitation and other outdoor elements. In one common example, a roof assembly includes at least one solid structural layer, typically made of plywood, covered by a plurality of shingles formed from asphalt, metal, tile, and other materials. It is also common to insulate the underside of the solid structural layer to provide a thermal barrier between the external environment and the interior of the building. However, it is well understood that moisture or moist air may seep into the insulation from edges or seams of the roof assembly. Consequently, these roof assemblies are believed to perform best when the underside of the solid structural layer is ventilated with an air flow that tends to remove any moisture from the insulation. This ventilation prevents or substantially eliminates mold growth and degradation of the insulation.

One particular design for ventilating a roof assembly is referred to as a vented nail base (VNB) roof assembly. These VNB roof assemblies include a first structural layer connected to the framework of the building, a second structural layer configured to receive shingles (e.g., the solid plywood panels), and an insulating layer between the first and second structural layers. The insulating layer may include one or more roof insulation panels such as foam insulation panels laying over the first structural layer. In order to provide a ventilating layer of air space between the foam insulation panels and the second structural layer, wooden block spacers have been inserted at various locations between the insulation panels and the second structural layer. This arrangement is described in further detail below with reference to FIG. 3.

However, these wooden block spacers suffer from several drawbacks. First, the wooden block spacers transmit the entire load of the second structural layer and the shingles directly onto the insulating layer. To this end, the structural support for the second structural layer and the shingles relies on the strength of the insulating layer. As a result, the structural support for the second structural layer and the shingles is relatively weak between wooden block spacers and along any edges of foam insulation panels used to form the insulating layer. Additionally, each of the wooden block spacers must be separately positioned and coupled to the foam insulation panels and/or the second structural layer, which is a tedious and time consuming process.

There is a need, therefore, for a roof assembly and a method of installing a roof assembly that addresses these and other drawbacks of current vented nail base roof assemblies.

SUMMARY OF THE INVENTION

According to the current invention, a ventilating purlin structure provides an advantageous alternative to the use of wooden block spacers in vented nail base roof assemblies. These ventilating purlins run along the edge of a foam insulation layer between upper and lower structural layers. Ventilating purlins can easily provide support along the entire edge, reducing or eliminating unsupported regions. The part of the ventilating purlin adjacent the ventilating air layer itself includes ventilation openings, so that the purlin provides supports without adversely restricting air flow. Each purlin may be constructed from a sheet of metal such as galvanized steel. The sheet of galvanized steel is folded to create a center upright support surface between two horizontal surfaces that can sit against the solid structures sandwiching the insulating and ventilating layers. The ventilating purlins therefore do not rely on either the insulating foam layer or the ventilating air layer for structural support, but rather span the distance between the two solid structural layers to provide support directly.

In accordance with one embodiment of the current invention, a roof assembly for covering a building includes a first structural layer coupled to the framework of the building. The roof assembly also includes an insulating layer including a roof insulation panel positioned above the first structural layer. A second structural layer is positioned above the insulating layer so as to define a ventilating layer of air space located between the insulating layer and the second structural layer. The roof assembly further includes a ventilating purlin extending between and contacting the first and second structural layers. The ventilating purlin includes at least one ventilation opening positioned to enable air flow through the ventilating purlin into the ventilating layer of air space.

In one aspect, the ventilating purlin also includes a generally planar main body with an upper edge contacting the second structural layer and a lower edge contacting the first structural layer. The main body may be formed from a generally rectangular sheet of galvanized steel. The ventilating purlin also includes an upper lip member extending transversely from the main body at the upper edge for abutting the second structural layer, and a lower lip member extending transversely from the main body at the lower edge for abutting the first structural layer. The upper lip member is generally planar adjacent the main body but includes a free end opposite the upper edge, this free end being angled or curved to encourage air flow through the ventilation opening. In one alternative, the upper and lower lip members extend from the main body in generally the same direction so as to define a generally C-shaped cross section of the ventilating purlin. In another alternative, the upper and lower lip members extend from the main body in generally opposite directions so as to define a generally S-shaped cross section of the ventilating purlin. The ventilation opening extends at least from the insulating layer to the upper edge when the ventilating purlin is positioned adjacent the insulating layer.

In another aspect, the second structural layer defines eaves with an eaves ventilation gap and a ridge with a ridge vent. The ventilation opening of the ventilating purlin is positioned to enable air flow through the ventilating layer of air space between the eaves ventilation gap and the ridge vent. In yet another aspect, the first structural layer includes rafters or trusses running along a first direction and the second structural layer includes solid plywood panels configured to receive shingles. The ventilating purlin then defines a longitudinal length which is oriented transverse to the first direction when the ventilating purlin is positioned between the first and second structural layers. In still another aspect, a plurality of ventilating purlins is positioned end-to-end along an elongate edge of the roof insulation panel so as to reinforce or strengthen the roof assembly at the edge of the roof insulation panel.

In another embodiment according to the invention, a ventilating purlin is configured to span a gap between first and second structural layers of a roof assembly. The ventilating purlin includes a generally planar main body with an upper edge for contacting the second structural layer and a lower edge for contacting the first structural layer. The ventilating purlin also includes at least one ventilation opening in the main body and positioned to enable air flow through the ventilating purlin into a ventilating layer of air space located between the first and second structural layers. For example, the ventilating purlin may be formed by bending a rectangular sheet of galvanized steel into the main body and upper and lower lip members extending transversely from the main body at the upper and lower edges, respectively.

In yet another embodiment according to the invention, a method for installing a roof assembly onto a building includes coupling a first structural layer to the framework of the building. The method also includes laying an insulating layer including a roof insulation panel onto the first structural layer so as to be positioned above the first structural layer. A ventilating purlin is coupled to the first structural layer adjacent the insulating layer such that a lower edge of the ventilating purlin abuts the first structural layer and an upper edge of the ventilating purlin extends above the insulating layer. The method further includes coupling a second structural layer to the upper edge of the ventilating purlin such that the second structural layer and the insulating layer are separated by a ventilating layer of air space. The ventilating purlin includes at least one ventilation opening positioned to enable air flow through the ventilating purlin into the ventilating layer of air space.

BRIEF DESCRIPTION OF THE DRAWINGS

The accompanying drawings, which are incorporated in and constitute a part of this specification, illustrate embodiments of the invention and, together with the detailed description of the embodiments given below, serve to explain the principles of the invention.

DETAILED DESCRIPTION

Figure 1:
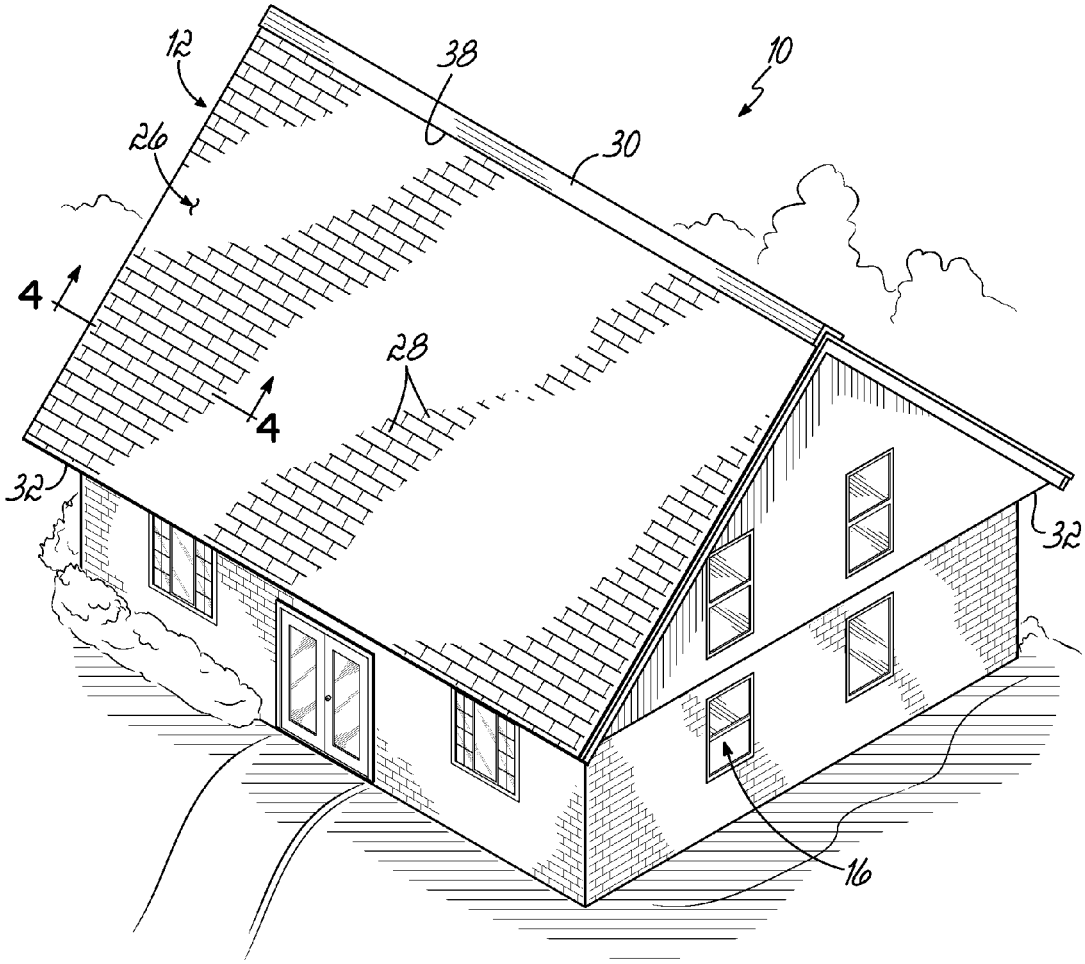
FIG. 1 is a perspective view of a house including a vented nail base (VNB) roof assembly according to one embodiment of the current invention.
Figure 2:
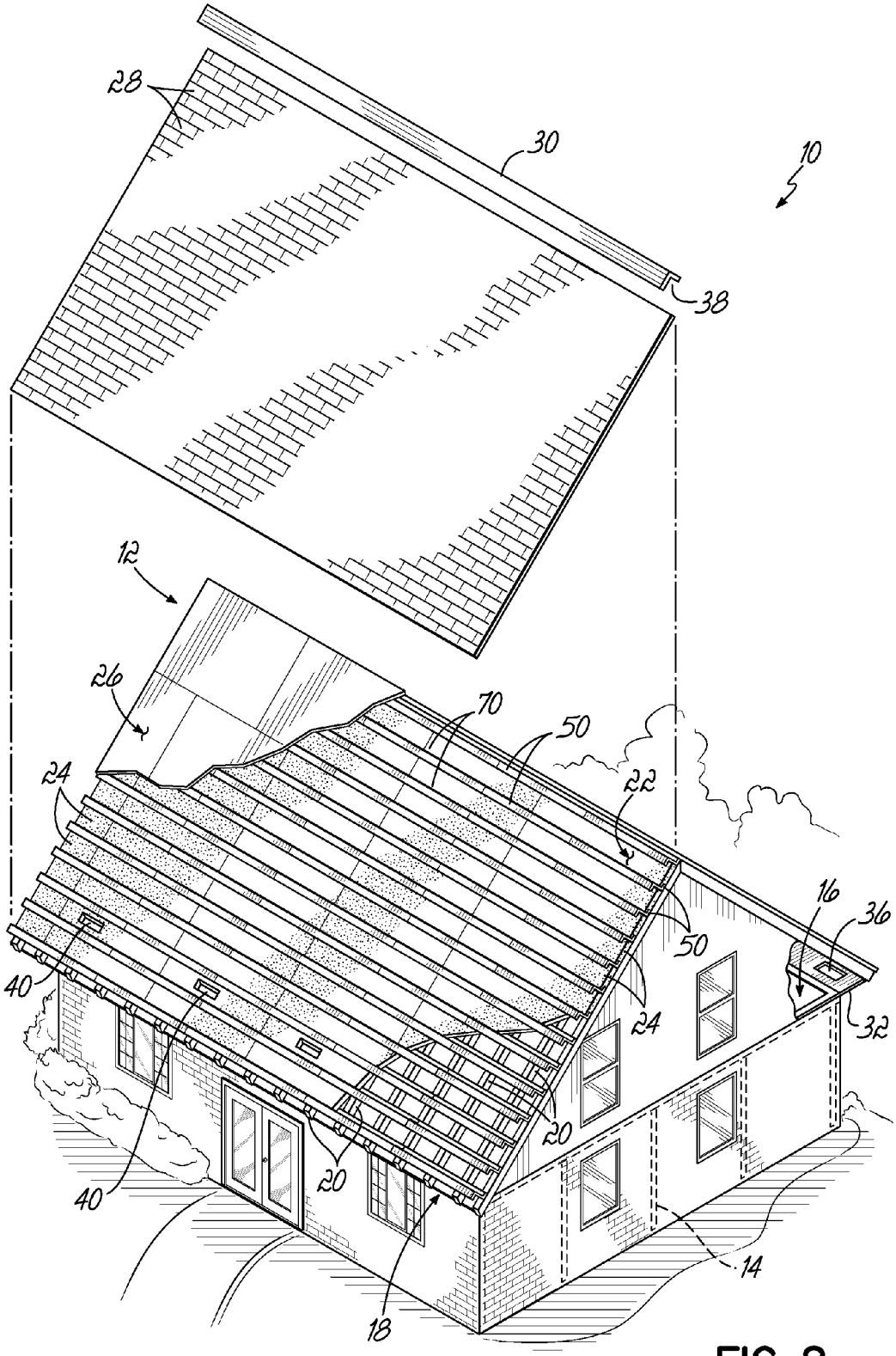
FIG. 2 is a perspective view of the house of FIG. 1, showing several layers of the roof assembly in partially exploded or cut away view.

With reference to FIGS. 1 and 2, a house 10 using a vented nail base (VNB) roof construction is shown in accordance with the current invention. More particularly, FIG. 1 shows the house 10 with a roof 12 installed on a framework 14 (FIG. 2) for protecting the interior 16 from precipitation and other environmental conditions. FIG. 2 illustrates the roof 12 exploded or cut away in various places to show the various layers: a first structural layer 18 including rafters or trusses 20 connected to the framework 14, an insulating layer 22 including a plurality of roof insulation panels 24 located above the first structural layer 18, a second structural layer 26 formed from plywood sheet(s) located above the insulating layer 22, and a plurality of shingles 28 located above the second structural layer 26. It will be understood that while the first structural layer 18 is shown as including trusses 20 and the second structural layer 26 is shown as receiving a plurality of shingles 28, the first and second structural layers 18, 26 may include or receive other roof elements in other embodiments consistent with the invention (for example, the first structural layer 18 may also include plywood sheet(s) coupled to the trusses 20). Each of the layers of the roof 12 extends from a ridge 30 at the top of the house 10 to one or more eaves 32 at the sides of the house 10. Depending on the particular framework of the house 10 or another building, the pitch, shape, and portions of the roof 12 may be modified without departing from the scope of the current invention, and the house 10 shown in FIGS. 1 and 2 includes a simple shape for a roof design.

In order to prevent the buildup of moisture and a resulting potential growth of mold within the insulating layer 22, the roof 12 is provided with ventilation by spacing the insulating layer 22 from the second structural layer 26. In this regard, a ventilating layer 34 of air space (shown in FIGS. 3 and 4) is provided between the roof insulation panels 24 and the plywood sheet(s) defining the second structural layer 26. The ventilating layer 34 extends substantially over the entire surface area of the roof 12 such that the roof insulation panels 24 at all locations from the ridge 30 to the eaves 32 are ventilated by air flow through the ventilating layer 34. The ventilating layer 34 receives air flow from an eaves ventilation gap 36 located at or underneath the eaves 32 to a ridge vent 38 located at the ridge 30. In some embodiments of the house 10, the ventilating layer 34 also receives air flow from the interior 16 via one or more vents 40 as shown in FIG. 2 through the insulating layer 22, although it will be appreciated that these vents 40 may not be present in all embodiments of the roof 12. The ventilating layer 34 of air space advantageously draws moisture that may leak into the roof 12 away from the insulating layer 22 to enhance the life cycle of the insulating layer 22 and improve the performance of the roof 12.

Figure 3:
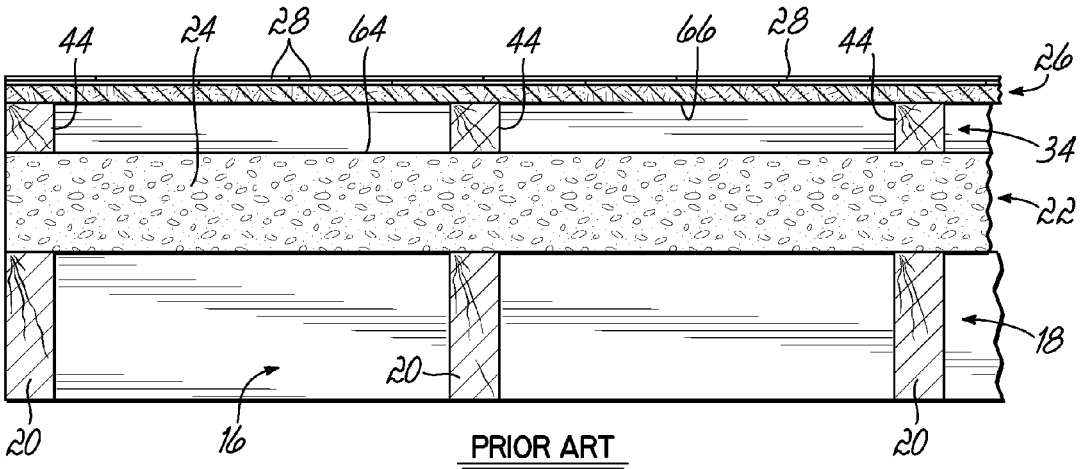
PRIOR ART FIG. 3
FIG. 3 is a front cross-sectional view of a conventional vented nail base roof assembly with wooden block spacers.

To provide this ventilating layer 34 in conventional vented nail base (VNB) roof designs, a plurality of wooden block spacers 44 were positioned between the roof insulation panels 24 and the second structural layer 26. With reference to FIG. 3, the conventional VNB roof design is shown including these wooden block spacers 44. To this end, the roof insulation panels 24 are supported on the trusses 20 of the first structural layer 18, and the second structural layer 26 is supported by the wooden block spacers 44 sitting atop the roof insulation panels 24. As a result, the structural support for the entire weight of the second structural layer 26 and the shingles 28 (as well as any snow buildup or other items on the roof) is carried by the wooden block spacers 44 and transmitted directly to the roof insulation panels 24. Although the roof insulation panels 24 may be formed from generally rigid foamed insulation material, the roof insulation panels 24 are not typically designed for load bearing and transmitting. Consequently, the structural support for the second structural layer 26 has a plurality of weak points, especially between wooden block spacers 44 and along edges of the roof insulation panels 24. These weak points may lead to a shorter life cycle for the conventional VNB roof design. Furthermore, the roof insulation panels 24 must be provided with a certain amount of structural rigidity to avoid collapsing and/or compressing, which limits the potential material possibilities for use in the insulating layer 22 of a VNB roof design.

Figure 4:
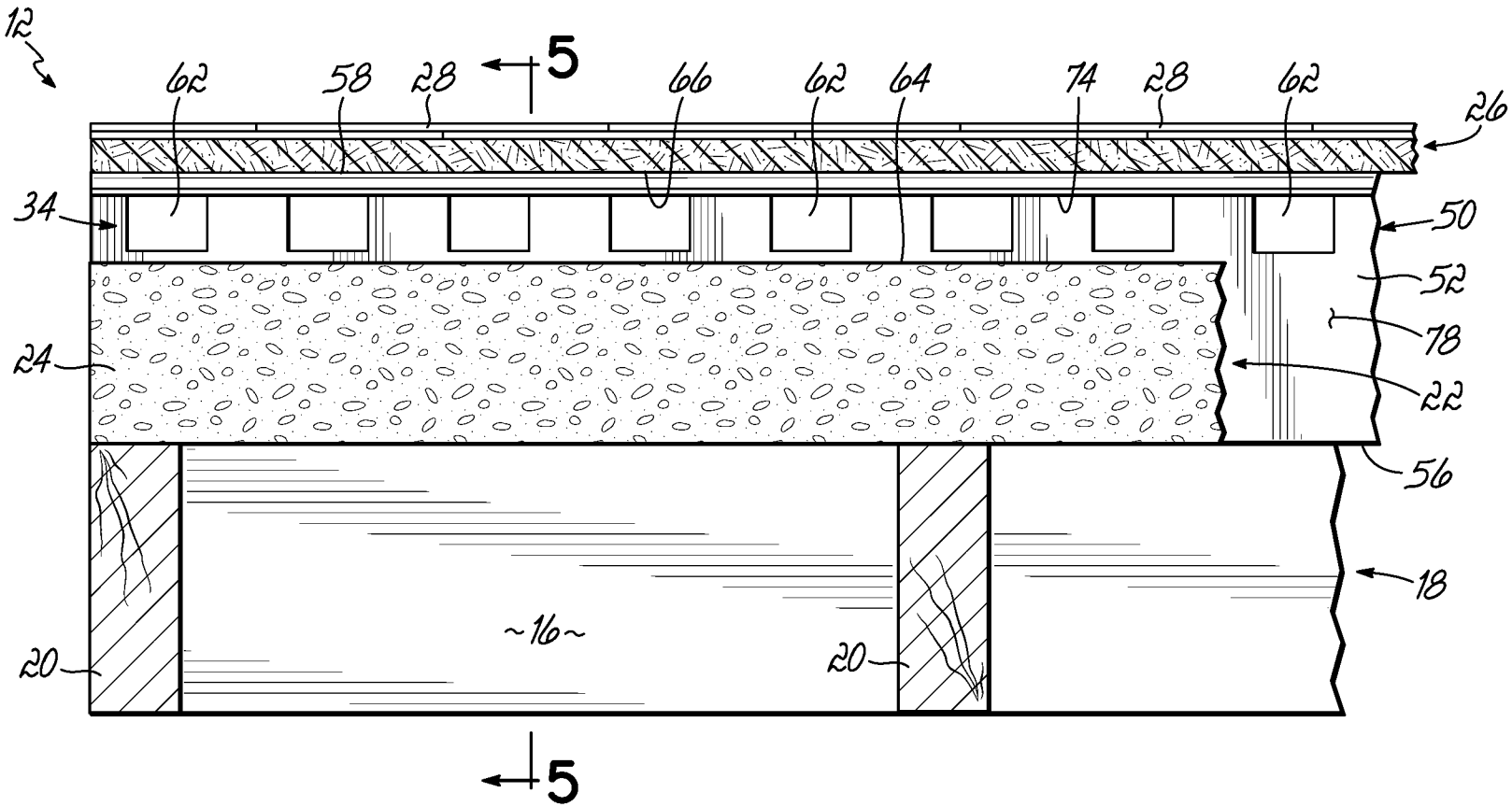
FIG. 4 is a front cross-sectional view of the VNB roof assembly of FIG. 1, taken along line 4-4.
Figure 5:
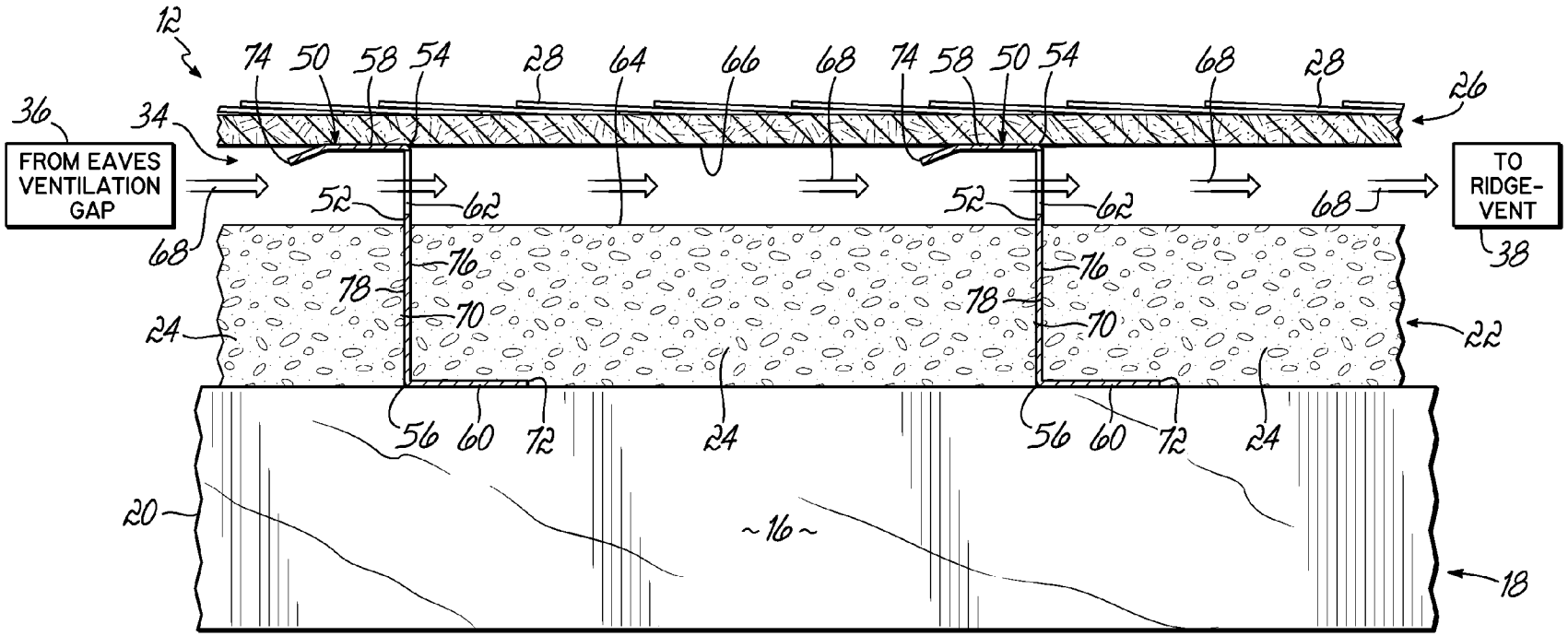
FIG. 5 is a side cross-sectional view of the VNB roof assembly of FIG. 4, taken along line 5-5.

With reference to FIGS. 4 and 5, the current invention addresses several of these drawbacks of the conventional design by including a ventilating purlin structure including one or more ventilating purlins 50 extending between and contacting the first structural layer 18 and the second structural layer 26 in the roof 12. These ventilating purlins 50 are also shown in position in FIG. 2. The ventilating purlin 50 according to a first embodiment is shown as installed in FIGS. 4 and 5 and before installation in FIGS. 6-8. As shown in these FIGS., this embodiment of the ventilating purlin 50 is formed with a generally S-shaped cross section including a generally planar main body 52 having an upper edge 54 contacting the second structural layer 26 and a lower edge 56 contacting the first structural layer 18, an upper lip member 58 extending transversely from the upper edge 54, and a lower lip member 60 extending transversely from the lower edge 56. The upper and lower lip members 58, 60 abut the corresponding second and first structural layers 26, 18 as shown in FIGS. 3 and 4. In this regard, the ventilating purlin 50 defines a rigid load bearing structure that directly abuts the first and second structural layers 18 to thereby transmit the weight load of the second structural layer 26 and the shingles 28 to the first structural layer 18 and the framework 14. Even more advantageously, the ventilating purlins 50 transmit the weight load without requiring that the roof insulation panels 24 of the insulating layer 22 bear or transfer any of the weight load. As a result, more types of insulating materials may be used for the insulating layer 22 without negatively impacting the structural integrity of the roof 12.

With continued reference to FIGS. 4 and 5, the ventilating purlin 50 of this embodiment also includes a plurality of ventilation openings 62 extending through the main body 52. The ventilation openings 62 are positioned adjacent the upper edge 54 such that the ventilation openings 62 communicate with the ventilating layer 34 of air space when the ventilating purlin 50 is installed in the roof 12. More specifically, each ventilation opening 62 defines a generally rectangular shape that extends from the upper edge 54 downwardly to a location adjacent an upper surface 64 of the insulating layer 22. Because the upper edge 54 of the main body 52 abuts a lower surface 66 of the second structural layer 26, the ventilation openings 62 are thus positioned across substantially the entire thickness of the ventilating layer 34 of air space. As a result, air flow through the ventilating layer 34 of air space flows through the ventilating purlin 50 with minimal flow impedance as indicated by the arrows 68 in FIG. 5. Although the arrows 68 shown in FIG. 5 indicate air flow movement from the eaves ventilation gap 36 to the ridge vent 38, it will be understood that the air flow direction may be reversed or otherwise modified during operation. Regardless of the flow direction, air is permitted to flow through the ventilating layer 34 and through the ventilation openings 62 in the ventilating purlin 50 to remove any moisture from the lower surface 66 of the second structural layer 26 or from the insulating layer 22.

Figure 6:
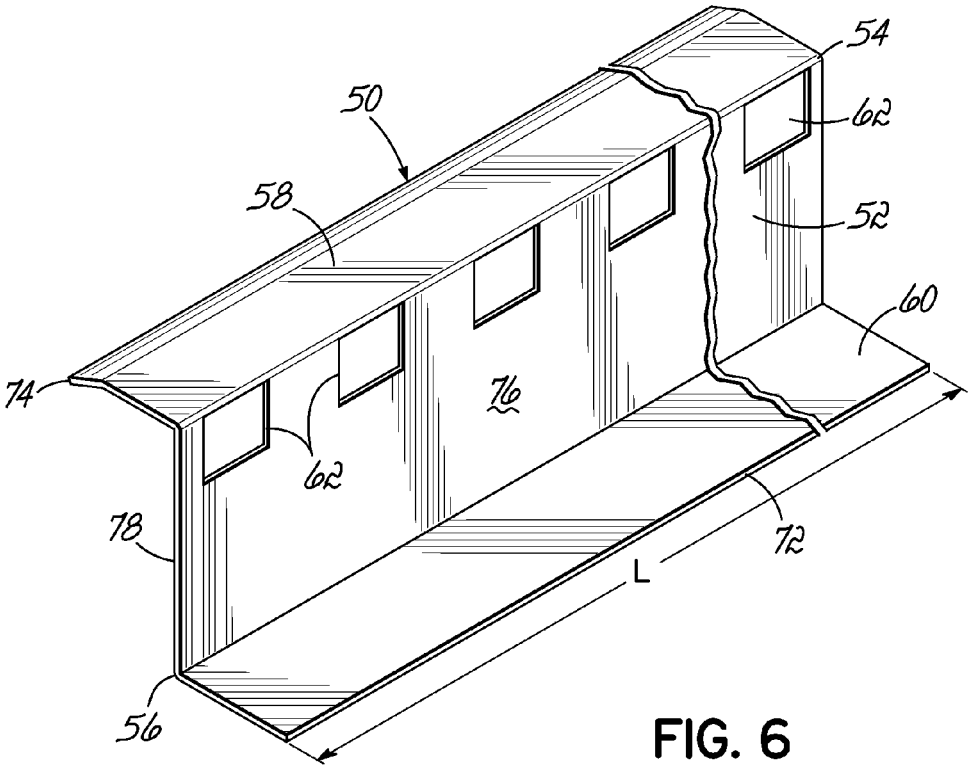
FIG. 6 is a perspective view of the S-shaped ventilating purlin used with the VNB roof assembly of FIGS. 4 and 5.
Figure 7:
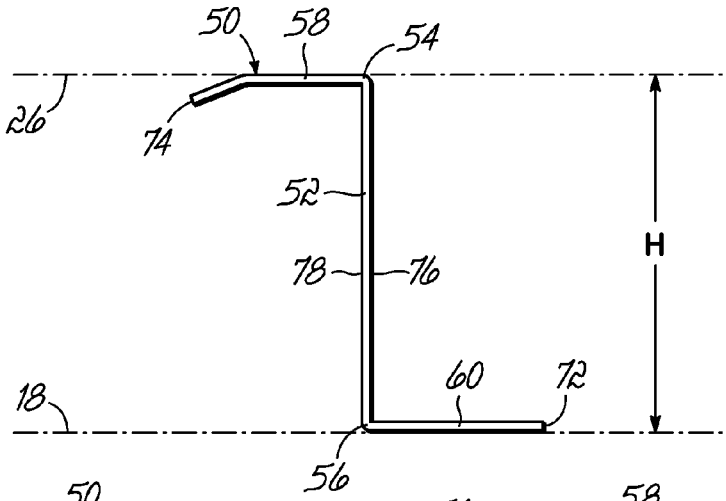
FIG. 7 is a side view of the ventilating purlin of FIG. 6.
Figure 8:
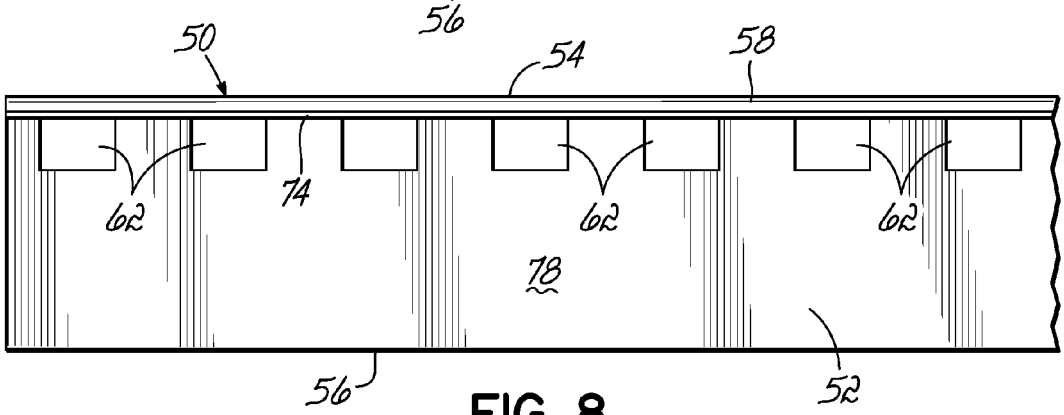
FIG. 8 is a front view of the ventilating purlin of FIG. 6.

Further details of the ventilating purlin 50 are more clearly shown in FIGS. 6-8. The ventilating purlin 50 is formed from sheet metal such as a sheet of galvanized steel. In this regard, the sheet metal is bent at the lower edge 56 and at the upper edge 54 to define the desired S-shaped cross section for the ventilating purlin 50. Although these bends are shown as generally right angles such that the upper and lower lip members 58, 60 are perpendicular to the main body 52, it will be understood that the bends may define slightly different angles in accordance with other embodiments of the invention. The relative location of the bends defines the height H (see FIG. 7) of the main body 52, which sets the total spacing between the first and second structural layers 18, 26 in the assembled roof 12.

The plurality of ventilation openings 62 is stamped or otherwise cut from the sheet metal before or after the upper and lower lip members 58, 60 are bent to be transverse to the main body 52. The length of the ventilation openings 62 is shown as roughly equivalent to the spacing between adjacent ventilation openings 62 in FIG. 8, and this configuration provides adequate air flow through the ventilating purlin 50 and enough structural material of the main body 52 to support the weight load of the second structural layer 26 and the shingles 28. It will be appreciated that the relative length of the ventilation openings 62 and the spacing between adjacent ventilation openings 62 may be modified in other embodiments of the current invention. The ventilating purlin 50 may be formed with any longitudinal length L (see FIG. 6) defined along the main body 52 depending on the relative spacing of trusses 20 to be used in the first structural layer 18. As the ventilating purlins 50 may be located end-to-end in abutting relation along the elongate edge 70 of a roof insulation panel 24 (see FIGS. 2 and 5), the total longitudinal length L may be modified to any convenient length. Moreover, each of the main body 52, the upper lip member 58, and the lower lip member 60 defines a generally planar portion with a relatively small thickness compared to longitudinal length L and height H (or width, in the case of the upper and lower lip members 58, 60) as a result of being formed from sheet metal.

With continued reference to FIGS. 6-8, the lower lip member 60 of this embodiment extends in a generally planar fashion from the lower edge 56 of the main body 52 to a free end 72. Similarly, the upper lip member 58 also extends transversely away from the upper edge 54 of the main body 52 to a free end 74. The upper lip member 58 extends in an opposite direction from the main body 52 than the lower lip member 60 so as to define the S-shaped cross section. The upper lip member 58 also extends in a generally planar fashion along most of the distance between the upper edge 54 and the free end 74, but the free end 74 of the upper lip member 58 is curved or angled downwardly as shown in FIG. 7. To this end, the free end 74 of the upper lip member 58 is configured as a scoop-shaped baffle for encouraging air flow through the ventilation openings 62 of the ventilating purlin 50, as shown in the installed state of FIG. 5. It will be understood that the particular angling or curvature of the free end 74 of the upper lip member 58 may be modified in other embodiments in accordance with the current invention. The curving or angling of the free end 74 may be instilled in the sheet metal at the same time the bends are applied at the upper and lower edges 54, 56 of the main body 52.

As shown in FIGS. 4 and 5, the ventilating purlin 50 of this embodiment is installed along elongate edges 70 of the roof insulation panels 24 such that one insulation panel 24 abuts a first side 76 of the main body 52 while a second insulation panel 24 abuts a second side 78 of the main body 52. To this end, the first side 76 faces toward the lower lip member 60 such that the insulation panel 24 adjacent that first side 76 sits partially atop the lower lip member 60. When the first structural layer 18 is defined at least in part by trusses 20 that extend along a first direction, the longitudinal length L of the ventilating purlins 50 is oriented transverse or perpendicular to this first direction such that the ventilating purlin 50 is supported by multiple trusses 20 (FIG. 2). In alternative embodiments in which the first structural layer 18 also includes a planar sheet of plywood, the specific orientation of the ventilating purlins 50 may be modified to match any corresponding elongate edges of the roof insulation panels 24 in the insulating layer 22. Additionally, the ventilating purlins 50 are arranged in end-to-end contact along the elongate edge 70 of the roof insulation panels 24 so that the second structural layer 26 is fully supported along the entire length of the elongate edge 70. Returning to the illustrated embodiment where the ventilating purlins 50 are transverse to the trusses 20, the combination of the ventilating purlins 50 and the trusses 20 forms a grid-like framework for supporting the weight load of the second structural layer 26 and the shingles 28. As described above, this combination provides a fully ventilated VNB roof 12 without relying on the insulating layer 22 for any structural load bearing capacity.

Figure 9:
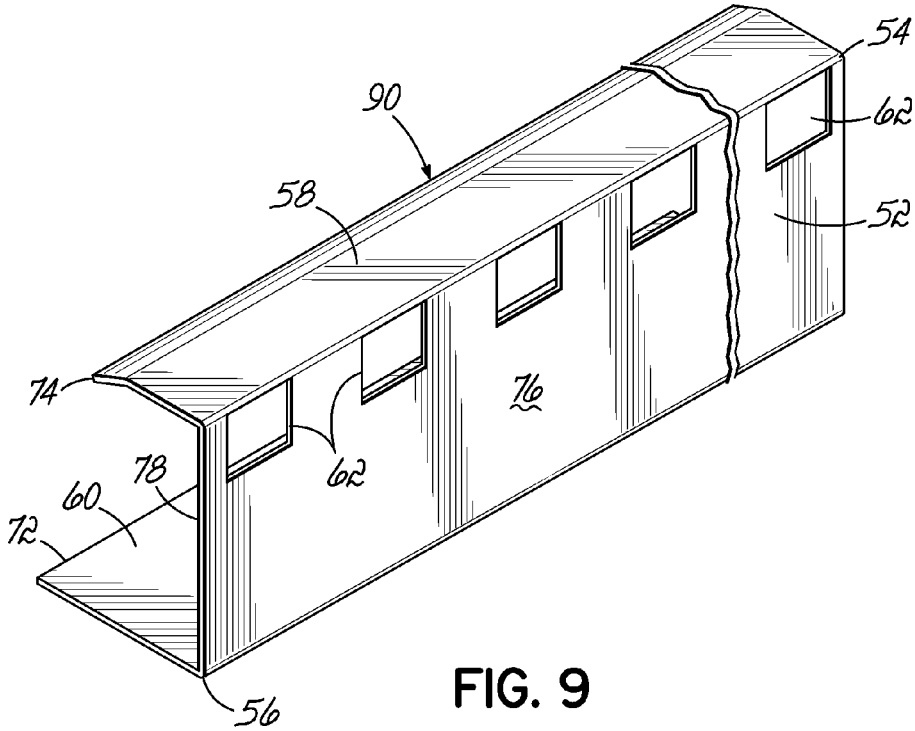
FIG. 9 is a perspective view of a C-shaped ventilating purlin used with the VNB roof assembly according to another embodiment of the invention.
Figure 10:
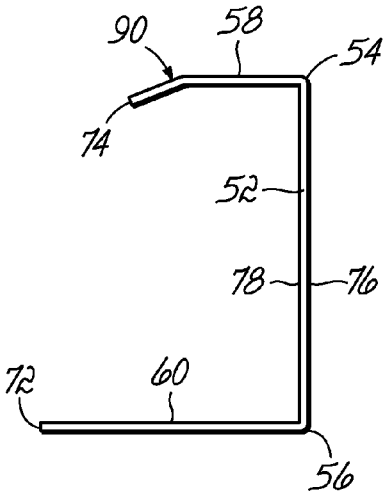
FIG. 10 is a side view of the ventilating purlin of FIG. 9.
Figure 11:
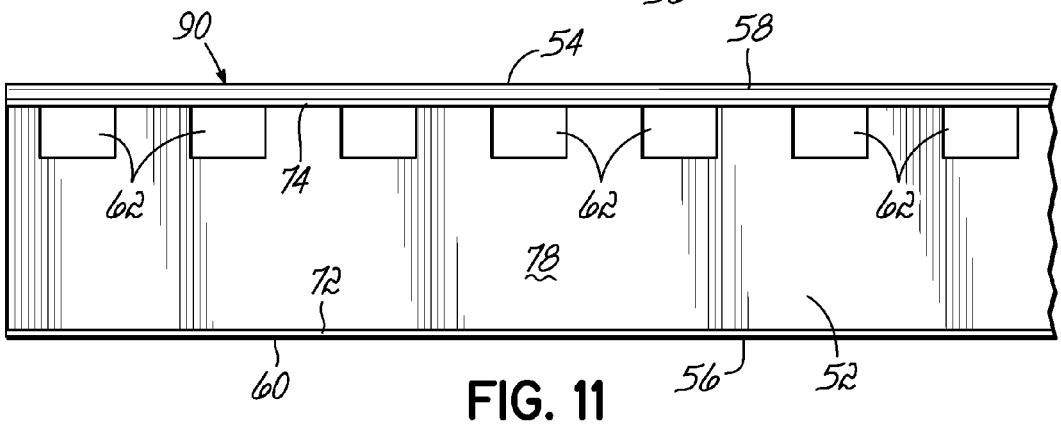
FIG. 11 is a front view of the ventilating purlin of FIG. 9.

An alternative embodiment of the ventilating purlin 90 according to the current invention is shown in FIGS. 9-11. The ventilating purlin 90 of this embodiment includes most of the same elements as the ventilating purlin 50 shown in FIGS. 4-8 (including the main body 52, the upper lip member 58, and the lower lip member 60), and these elements have been marked with the same reference numbers without further description below. The one difference of this embodiment of the ventilating purlin 90 is that the upper and lower lip members 58, 60 are bent to extend in generally the same direction from the main body 52. For example, the upper and lower lip members 58, 60 each extend transversely away from the second side 78 of the main body 52 so as to define a C-shaped cross section for the ventilating purlin 90. Similar to the previous embodiment, the ventilating purlin 90 includes ventilation openings 62 for providing air flow through a ventilating layer 34 of air space and the ventilating purlin is configured to abut elongate edges of two roof insulation panels 24 abutting the first and second sides 76, 78 of the main body 52. Although not shown in the FIGS., the particular cross sectional shape of the ventilating purlin 50, 90 may be modified in other embodiments without departing from the scope of the invention, as long as the ventilating purlin 50, 90 includes the main body 52 for transferring weight loads and the ventilation openings 62 for permitting air flow through the ventilating layer 34 of air space.

Regardless of the particular embodiment of the ventilating purlin 50, 90 chosen, the roof 12 of the current invention may be installed by the following process. Once the framework 14 for the house 10 is completed, a plurality of trusses 20 or rafters may be coupled to the framework 14 to define a first structural layer 18. A layer of plywood may optionally be attached to the trusses 20 in some embodiments as a part of this first structural layer 18. A plurality of roof insulation panels 24 are then laid onto the first structural layer 18 and may be secured thereto to define the insulating layer 22. During installation of these roof insulation panels 24, the ventilating purlins 50, 90 may also be positioned along elongate edges 70 of the roof insulation panels 24 and coupled to the first structural layer 18. The plywood sheets forming the second structural layer 26 are then coupled to the ventilating purlins 50, 90 adjacent the upper edge 54 such that the second structural layer 26 is spaced from the insulating layer 22 by a ventilating layer 34 of air space. Shingles 28 or another similar covering may then be attached to the second structural layer 26 as known in the roofing art to complete the VNB roof 12 according to the invention.

Advantageously, the ventilating purlins 50, 90 of the roof 12 provide direct engagement and load transfer from the second structural layer 26 to the first structural layer 18. As a result, the roof insulation panels 24 do not bear any of the weight load of the second structural layer 26, which enables all types of foamed and non-foamed insulation panels to be used in the insulating layer 22. Additionally, the ventilating purlins 50, 90 do not adversely affect air flow through the ventilating layer 34 of air space defined between the second structural layer 26 and the insulating layer 22, which enables the VNB roof 12 to be reliably ventilated and fully supported structurally. Therefore, the VNB roof 12 of the current invention addresses many of the drawbacks associated with conventional VNB roof designs without adversely impacting the benefits of such a roof construction.

While the present invention has been illustrated by the description of specific embodiments thereof, and while these embodiments have been described in considerable detail, it is not intended to restrict or in any way limit the scope of the appended claims to such detail. The various features discussed herein may be used alone or in any combination. Additional advantages and modifications will readily appear to those skilled in the art. For example, the ventilating purlins 50, 90 may be formed from a different material than sheet metal or galvanized steel. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A method for installing a roof assembly onto a building having a framework, the method comprising:

coupling a first structural layer to the framework of the building;

laying an insulating layer including a roof insulation panel made from foamed insulation material onto the first structural layer so as to be positioned above the first structural layer;

coupling a ventilating purlin to the first structural layer adjacent the insulating layer such that a lower edge of the ventilating purlin abuts the first structural layer and an upper edge of the ventilating purlin extends above the insulating layer; and coupling a second structural layer into abutting contact with the upper edge of the ventilating purlin such that the second structural layer and the insulating layer are separated by a ventilating layer of air space and such that a weight load of the second structural layer is transmitted through the ventilating purlin to the first structural layer, the ventilating purlin extending through the insulating layer such that the insulating layer does not bear any of the weight load of the second structural layer, wherein the ventilating purlin includes at least one ventilation opening positioned to enable air flow through the ventilating purlin into the ventilating layer of air space.

2. The method of claim 1, wherein the ventilating purlin includes a main body having the upper and lower edges, an upper lip member extending transversely from the main body at the upper edge, and a lower lip member extending transversely from the main body at the lower edge, and the method further comprises:

coupling the lower lip member with the first structural layer after positioning the lower edge into abutting contact with the first structural layer; and coupling the upper lip member with the second structural layer after positioning the upper edge into abutting contact with the second structural layer.

3. The method of claim 1, further comprising:

positioning the ventilating purlin relative to the insulating layer such that the at least one ventilation opening extends at least from the upper edge to the insulating layer, thereby providing communication throughout the ventilating layer of air space.

4. The method of claim 1, wherein the second structural layer further includes eaves with an eaves ventilation gap and a ridge with a ridge vent, and the method further comprises:

positioning the ventilating purlin such that the at least one ventilation opening provides air flow through the ventilating layer of air space and between the eaves ventilation gap and the ridge vent.

5. The method of claim 1, wherein the first structural layer includes rafters and/or trusses running along a first direction, the second structural layer includes solid plywood panels configured to receive shingles, and the method further comprises:

positioning the ventilating purlin such that a longitudinal length of the ventilating purlin is oriented transverse to the first direction when the ventilating purlin is coupled between the first and second structural layers.

6. The method of claim 1, wherein the roof insulation panel of the insulating layer includes at least one elongate edge between the first and second structural layers, and the method further comprises:

installing a plurality of ventilating purlins so as to be positioned end-to-end along the elongate edge of the roof insulation panel, thereby enabling the plurality of ventilating purlins to transmit the weight load of the second structural layer to the first structural layer without transmitting any of the weight load of the second structural layer to the roof insulation panel.

7. A roof assembly for covering a building having a framework, the roof assembly comprising:

a first structural layer coupled to the framework of the building;

an insulating layer including a roof insulation panel made from foamed insulation material and positioned above the first structural layer;

a second structural layer positioned above the insulating layer so as to define a ventilating layer of air space located between the insulating layer and the second structural layer; and a ventilating purlin extending between and abutting each of the first and second structural layers such that a weight load of the second structural layer is transmitted through the ventilating purlin to the first structural layer, the ventilating purlin extending through the insulating layer such that the insulating layer does not bear any of the weight load of the second structural layer, the ventilating purlin including at least one ventilation opening positioned to enable air flow through the ventilating purlin into the ventilating layer of air space.

8. The roof assembly of claim 7, wherein the ventilating purlin further includes a generally planar main body including an upper edge contacting the second structural layer and a lower edge contacting the first structural layer.

9. The roof assembly of claim 8, wherein the main body of the ventilating purlin is formed from a generally rectangular sheet of galvanized steel.

10. A roof assembly for covering a building having a framework, the roof assembly comprising:

a first structural layer coupled to the framework of the building;

an insulating layer including a roof insulation panel made from foamed insulation material and positioned above the first structural layer;

a second structural layer positioned above the insulating layer so as to define a ventilating layer of air space located between the insulating layer and the second structural layer; and a ventilating purlin extending between and contacting the first and second structural layers, the ventilating purlin including at least one ventilation opening positioned to enable air flow through the ventilating purlin into the ventilating layer of air space, wherein the ventilating purlin further includes a generally planar main body including an upper edge contacting the second structural layer and a lower edge contacting the first structural layer, and wherein the ventilating purlin further includes an upper lip member extending transversely from the main body at the upper edge and a lower lip member extending transversely from the main body at the lower edge, the lower and upper lip members configured to abut the first and second structural layers, respectively.

11. The roof assembly of claim 10, wherein the at least one ventilation opening extends at least from the insulating layer to the upper edge when the ventilating purlin is positioned adjacent the insulating layer.

12. The roof assembly of claim 10, wherein the upper lip member and the lower lip member extend from the main body in generally the same direction so as to define a generally C-shaped cross section of the ventilating purlin.

13. The roof assembly of claim 10, wherein the upper lip member and the lower lip member extend from the main body in generally opposite directions so as to define a generally S-shaped cross section of the ventilating purlin.

14. The roof assembly of claim 7, wherein the second structural layer defines eaves with an eaves ventilation gap and a ridge with a ridge vent, and the at least one ventilation opening of the ventilating purlin is positioned to enable air flow through the ventilating layer of air space between the eaves ventilation gap and the ridge vent.

15. The roof assembly of claim 7, wherein the first structural layer includes rafters and/or trusses running along a first direction, the second structural layer includes solid plywood panels configured to receive shingles, and the ventilating purlin defines a longitudinal length that is oriented transverse to the first direction when the ventilating purlin is positioned between the first and second structural layers.

16. The roof assembly of claim 7, wherein the roof insulation panel of the insulating layer includes at least one elongate edge between the first and second structural layers, and the roof assembly comprises:

a plurality of ventilating purlins positioned end-to-end along the elongate edge of the roof insulation panel.

* * * * *